US006387186B1

(12) United States Patent
Reisig et al.

(10) Patent No.: US 6,387,186 B1
(45) Date of Patent: May 14, 2002

(54) PROCESS FOR PRODUCTION OF PURIFIED BEET JUICE FOR SUGAR MANUFACTURE

(75) Inventors: Richard C. Reisig, Scottsbluff, NE (US); Jatal D. Mannapperuma, Davis, CA (US)

(73) Assignee: Tate & Lyle, Inc., Decatur, IL (US)

( * ) Notice: Subject to any disclaimer, the term of this patent is extended or adjusted under 35 U.S.C. 154(b) by 0 days.

(21) Appl. No.: 09/376,026

(22) Filed: Aug. 19, 1999

(51) Int. Cl.[7] ..... C13D 1/00; C13D 3/16
(52) U.S. Cl. ..... 127/55; 127/54
(58) Field of Search ..... 127/54, 55

(56) References Cited

U.S. PATENT DOCUMENTS

| | | | |
|---|---|---|---|
| 1,578,463 A | 3/1926 | Nicholson et al. | |
| 1,815,276 A | 7/1931 | Schwieger | |
| 2,164,186 A | 6/1939 | Brown et al. | 127/50 |
| 2,557,800 A | 6/1951 | Seailles | 127/52 |
| 2,697,049 A | 12/1954 | Brieghel-Müller | 127/50 |
| 2,801,940 A | 8/1957 | Stark et al. | 127/44 |
| 2,824,028 A | 2/1958 | Zenzes | 127/50 |
| 2,977,253 A | 3/1961 | Grandadam | 127/50 |
| 3,113,044 A | 12/1963 | Alston | 127/48 |
| 3,168,419 A | 2/1965 | Gale | 127/50 |
| 3,926,662 A | 12/1975 | Rundell et al. | 127/48 |
| 4,057,437 A | 11/1977 | Kracklauer | 127/9 |
| 4,115,147 A | 9/1978 | Shimizu et al. | 127/54 |
| 4,328,043 A | 5/1982 | Freytag et al. | 127/44 |
| 4,332,622 A | 6/1982 | Hohnerlein, Jr. | 127/41 |
| 4,432,806 A | 2/1984 | Madsen et al. | 127/48 |
| 4,478,645 A | 10/1984 | Gudnason | 127/57 |
| 4,702,839 A | 10/1987 | Koerts et al. | 210/638 |
| 4,716,044 A | 12/1987 | Thomas et al. | 426/51 |
| 4,795,494 A | 1/1989 | Toth et al. | 127/48 |
| 5,145,584 A | 9/1992 | Swamikannu | 210/650 |

(List continued on next page.)

FOREIGN PATENT DOCUMENTS

| | | |
|---|---|---|
| CS | 107886 | 7/1963 |
| DE | 813139 | 9/1951 |
| DE | 942552 | 5/1956 |
| DE | 1 003 150 | 8/1957 |
| EP | 0 126 512 | 11/1984 |
| EP | 0 655 507 | 5/1995 |
| EP | 0 957 178 A2 | 11/1999 |
| GB | 477 312 | 3/1936 |
| GB | 1 361 674 | 7/1974 |
| WO | WO92/08810 | 5/1992 |
| WO | WO92/10948 | 7/1992 |
| WO | WO93/07766 | 4/1993 |
| WO | WO95/27798 | 10/1995 |
| WO | WO96/04406 | 2/1996 |
| WO | WO97/43454 | 11/1997 |
| WO | WO98/24331 | 6/1998 |

OTHER PUBLICATIONS

Nielsen et al., "Prospects and Possibilities in Application of Membrane Filtration Systems Within the Beet and Cane Sugar Industry," *Sugar Technology Reviews* 9:59–117 (1982) No Month Provided.

(List continued on next page.)

*Primary Examiner*—David Brunsman
(74) *Attorney, Agent, or Firm*—Williams, Morgan & Amerson P.C.

(57) ABSTRACT

The present invention relates to a process for producing sugar from beets, comprising the steps of: (a) macerating beets or pieces thereof; (b) mechanically separating juice from the macerated beets; and (c) membrane filtering the separated juice, producing a retentate and a permeate. The mechanical extraction of juice can be done on a moving porous vacuum filtration belt with countercurrent flow of macerated beets and water. The pH of the vacuum extracted juice can be adjusted to at least about 7 by addition of sodium hydroxide. This process does not use conventional beet diffusion. No lime and no carbon dioxide are required to be contacted with the juice or the permeate in this process.

17 Claims, 2 Drawing Sheets

U.S. PATENT DOCUMENTS

| | | | | | |
|---|---|---|---|---|---|
| 5,281,279 | A | | 1/1994 | Gil et al. | 127/46.1 |
| 5,320,681 | A | | 6/1994 | Moe et al. | 127/46.1 |
| 5,403,604 | A | | 4/1995 | Black, Jr. et al. | 426/330.5 |
| 5,466,294 | A | | 11/1995 | Kearney et al. | 127/42 |
| 5,468,300 | A | | 11/1995 | Monclin | 127/43 |
| 5,468,301 | A | | 11/1995 | Monclin | 127/43 |
| 5,480,490 | A | | 1/1996 | Toth et al. | 127/42 |
| 5,554,227 | A | | 9/1996 | Kwok et al. | 127/58 |
| 5,685,990 | A | | 11/1997 | Saugmann et al. | 210/650 |
| 5,747,089 | A | | 5/1998 | Ljusberg et al. | 426/478 |
| 5,759,283 | A | | 6/1998 | Ekern et al. | 127/42 |
| 5,865,899 | A | * | 2/1999 | Theoleyre et al. | 127/42 |
| 5,902,408 | A | | 5/1999 | Player et al. | 127/30 |
| 5,902,409 | A | | 5/1999 | Kwok et al. | 127/58 |
| 6,096,136 | A | * | 8/2000 | Saska | 127/42 |

OTHER PUBLICATIONS

Kishihara et al., "Improvement of Flux in Ultrafiltration of Cane Juice," *Int. Sugar Jnl.* 85:99–102 (1983) No Month Provided.

Hanssens et al., "Ultrafiltration as an Alternative for Raw Juice Purification in the Beet Sugar Industry" (17$^{th}$ General Assembly of C.I.T.S., Cophenhagen 1983) No Month Provided.

"Membrane Filtration," *Food Engineering* (Nov. 1987).

"Purification Using Membrane Filtration," *Sugar Journal* (Nov. 1994).

Abram et al., "Sugar Refining: Present Technology and Future Developments," *Sugar: Science and Technology*, Chapter 3, pp. 49–95 (1979) No Month Provided.

Kort, "Colour in the Sugar Industry," *Sugar: Science and Technology*, Chapter 4, pp. 97–130 (1979) No Month Provided.

Reinefeld, "Progress in the Technology of Beet–Sugar," *Sugar: Science and Technology*, Chapter 5, pp. 131–149 (1979) No Month Provided.

Chen, "Outline of Process for Manufacturing Raw Cane Sugar," *Cane Sugar Handbook*, Chapter 2, pp. 47–105, 127–186 and 526–559 (1985) No Month Provided.

Lancrenon et al., "Mineral Membranes for the Sugar Industry," *Sugar y Azucar*, pp. 40–45 (1993) No Month Provided.

Hartmann, "Lime and Carbon Dioxide Production," *Beet–Sugar Technology*, Chapter XVII, pp. 567–593 (1982) No Month Provided.

Toth, "The Wescot Juice Purification System" (1989 ASSBT Meeting, New Orleans, Louisiana, Feb. 26(March 2, 1989)

"Beet Sugar Process," Western Sugar No Date Provided.

Derwent Abstract, DD 136455 (1979) No Month Provided.

Derwent Abstract, DE 3229345 (1984) No Month Provided.

Derwent Abstract, EP 635578 (1995) No Month Provided.

Derwent Abstract, EP 655507 (1995) No Month Provided.

Derwent Abstract, RU 2016637 (1994) No Month Provided.

Derwent Abstract, JP 5004929 (1993) No Month Provided.

Derwent Abstract, JP 6287199 (1994) No Month Provided.

Derwent Abstract, SU 1669984 (1991) No Month Provided.

Derwent Abstract, NL 8800175 (1989) No Month Provided.

Derwent Abstract, FR 2586360 (1987) No Month Provided.

Derwent Abstract, US 4999116 (1991) No Month Provided.

Derwent Abstract, RU 2016637 (1994) No Month Provided.

Derwent Abstract, JP 5004929 (1993) No Month Provided.

Derwent Abstract, US 5008254 (1991) No Month Provided.

Derwent Abstract, SU 1756817 (1992) No Month Provided.

Derwent Abstract, WO 9208810 (1992) No Month Provided.

Freeman, *Sugar* 48:161–162 (1954) No Month Provided.

Dorfeldt, *Sugar Abstracts*, p. 56 (1952) No Month Provided.

Brownell et al., *Sugar*, p. 66 (1952) No Month Provided.

Cheryan, "Membrane Separation Processes and Their Use in Purifying or Concentrating Liquid Food Systems," Fall '91 Meeting of R&DA for Military Food & Packaging Systems, Inc. (Boston, MA,(Oct. 8, 1991).

Urano et al., *Nippon Shokuhin Kagaku Kogaku Kaishi* 44:457–462 (1997) No Month Provided.

Madsen, *Int. Sugar Jnl.* 92:221–223 (1990) No Month Provided.*

Saska et al. (Part I), *Sugar Journal*, pp. 19–21 (Nov. 1995).*

Saska et al. (Part II), *Sugar Journal*, pp. 29–31 (Dec. 1995).*

Saska et al., "Concentration and Decolorization of Dilute Products from Cane Molasses Desugarization with Reverse Osmosis and Nanofiltration Membranes," 1994 Sugar Industry Technologists Meeting (Honolulu, Hawaii, (May 8, 1994).*

Cartier et al., *Ind. Alim. Agr. Juillet/Aout*, pp. 557–560 (1996) No Month Provided [French language].*

Spengler et al., *Ztschr. Wirtschaftsgruppe Zuckerind.* 91:275–333 (1941) No Month Provided [part. translation].*

Müller, *Zeitschrift fur die Zuckerindustrie*, pp. 207–209 (Apr. 1961) [translation].*

"Desugarization of Sugar Beet Mash," *Zucker* (1952) No Month Provided [translation].*

Dörfeldt, *Zuckerindustrie: Fachorgan für Technik, Rübenbau and Wirtschaft* 2:379–383 (1952) No Month Provided (translation).*

Schneider, *Technologie des Zuckers*, excerpts from pp. 135–136, 171 (1968) No Month Provided [part. translation].*

PCT/US00/22301, International Search Report (May 29, 2001).

* cited by examiner

PROCESS FOR PRODUCTION OF PURIFIED BEET JUICE FOR SUGAR MANUFACTURE

BACKGROUND OF THE INVENTION

The present invention relates to a process for producing sucrose from sugar beets.

The conventional beet sugar manufacturing process involves cleaning the beets, slicing them into cossettes, extracting juice from the cossettes by diffusion, purifying the juice by liming and carbonation, concentrating the juice by multiple effect evaporation, multi-stage boiling of concentrated juice in pans, separation, washing, and drying the sugar.

Juice extraction in the conventional process is done by allowing the sugar to diffuse through the natural cell walls of beets. The cell walls allow sugars and other low molecular weight compounds to pass through but prevent the passage of high molecular weight compounds. This selective diffusion process has two advantages. Retaining the high molecular weight compounds helps produce a high purity juice. It also reduces filtration difficulties that are caused by polysaccharides and proteins that comprise the high molecular weight compounds.

Purification of beet juice in the conventional process is based on lime treatment. Lime serves many purposes in the juice purification process. It neutralizes the acidity of the juice and precipitates calcium salts of several organic and inorganic acids. The precipitate absorbs other impurities. The lime precipitate produces a porous mass, which facilitates subsequent filtration of juice.

The conventional diffusion process for juice extraction from beets has two disadvantages. It has a long retention time, which encourages microbial growth, resulting in sugar loss and formation of undesirable compounds. Also the diffusion process has limited extraction capability, leaving about 2–5% of the original sugar in the pulp. This pulp is pressed and the press juice is introduced back into the diffuser. A significant portion of the high molecular weight compounds retained by the cell walls in the diffusion process is released in pressing to be mixed with the diffusion juice. This partially negates the advantages of the selective diffusion process.

The conventional liming process uses large quantities of lime, amounting to about 2.5% of the total weight of beets processed. Beet sugar plants operate lime kilns and transport limestone over long distances for this purpose. The effluent from the liming-carbonation process, consisting of used lime and separated impurities, is disposed as waste. Production of lime and disposal of liming effluent are costly operations. Disposal of liming effluent is becoming increasingly difficult and expensive in many communities.

Conventional dead-end filtration is incapable of separating sucrose from macromolecular impurities in beet juice. Several methods of using microfiltration and ultrafiltration for purification of juice with reduced lime use have been reported, but these methods generally involve inserting microfiltration or ultrafiltration membranes into the conventional beet process at one or more points.

There is a long-standing need for improved processes for obtaining sugar from beets that avoid or at least minimize one or more of the problems existing in the previously used processes.

SUMMARY OF THE INVENTION

The present invention relates to a process for producing sugar from beets, comprising the steps of (a) macerating beets or pieces thereof; (b) mechanically separating juice from the macerated beets; and (c) membrane filtering the separated juice, producing a retentate and a permeate. The present invention makes use of mechanical means, such as vacuum filtration, for separating juice from macerated beets, as opposed to the simple diffusion process that is used in prior beet processing technology to obtain juice from cossettes.

In certain preferred embodiments of the process, where beets are cut into pieces and subsequently macerated, and the maceration is done in an attrition mill. It is also preferred that vacuum extraction of juice is done on a moving porous filtration belt with countercurrent flow of macerated beets and water, most preferably at a temperature of at least about 80° C. The pH of the vacuum extracted juice preferably is adjusted to at least about 7 by addition of sodium hydroxide.

In one preferred embodiment of the process, the extracted juice is contacted with an agent selected from the group consisting of sulfur dioxide, sulfate salts, sulfite salts, bisulfite salts, and mixtures thereof, in an amount sufficient to adjust the pH of the extracted juice to no greater than about 8.

The membrane filtration can suitably be done with an ultrafiltration membrane, a nanofiltration membrane, or other types of membranes described herein. In one preferred embodiment, the membrane filtration is cross-flow ultrafiltration, and is done at least about 80° C, and the pH of the permeate is at least about 7.

One preferred option in the process is to subject the retentate from the membrane filtration to diafiltration, in order to recover residual sugar in the retentate, thereby producing a diafiltration filtrate (also referred to herein as diafiltrate). This diafiltrate preferably is combined with the membrane filtration permeate for further processing.

Another preferred option in the process is concentration of the permeate from the membrane filtration by reverse osmosis, thereby producing a concentrated solution. This concentrated solution is evaporated and sucrose is crystallized therefrom.

Preferably in the process of the present invention no lime and no carbon dioxide are contacted with the juice or the permeate.

One specific preferred embodiment of the process comprises the steps of: (a) cutting sugar beets into pieces; (b) macerating the beet pieces; (c) mechanically extracting juice from the macerated beets; (d) sulfitation of the extracted juice; (e) pH adjustment of the extracted juice to at least about 7; (f) membrane filtering the extracted juice, producing a retentate and a permeate; (g) subjecting the retentate to diafiltration, thereby producing a diafiltration filtrate that is enriched in sugar compared to the retentate; (h) combining the diafiltration filtrate and the permeate from the membrane filtration, thereby producing a combined juice; (i) concentrating the combined juice by reverse osmosis, thereby producing a concentrated solution; and (j) evaporating the concentrated solution and crystallizing sucrose therefrom.

The process of the present invention has many advantages over the conventional process using diffusion, liming and carbonation. For instance, this process has a lower retention time, which reduces the extent of microbial destruction of sucrose. The fineness of the macerated beets reduces the percentage of sucrose retained in the pulp to below about 0.5% compared to as high as 0.75% in the conventional process. Higher extraction due to maceration and reduction in inversion due to reduced retention time increase the total sugar recovery by about 1 to 2% of the weight of beets processed.

This method of purification produces a beet juice of lower color than the traditional diffusion and carbonation process. Less color in the juice allows for less washing of the final crystalline product. Membrane filtration removes macromolecules in the beet juice, producing syrups of lower viscosity. Lower viscosity syrups crystallize faster and purge easier from the sucrose crystal surface. Low color, low viscosity syrup, reduces recycle during the crystallization process, resulting in better sugar recovery.

The process eliminates the lime kiln, lime quarries and all associated equipment, processes, products, by-products and waste products. Sodium hydroxide for neutralization of juice costs about 50% less than the lime that it replaces. Sodium hydroxide is easier to handle, cleaner and less abrasive on equipment than lime.

Also, the present invention results in a drastic reduction of waste products that cause environmental pollution. The conventional process produces a filter cake that comprises products of the liming process and impurities removed from the juice. This cake is disposed into ponds or landfills. The proposed process completely eliminates the need for disposal of such materials. Invert sugars end up with the molasses which is a salable byproduct and not in the effluent. The present invention also allows elimination of the carbonation process, which is a major source of atmospheric pollution in beet sugar plants.

DETAILED DESCRIPTION OF SPECIFIC EMBODIMENTS

Figure 1:
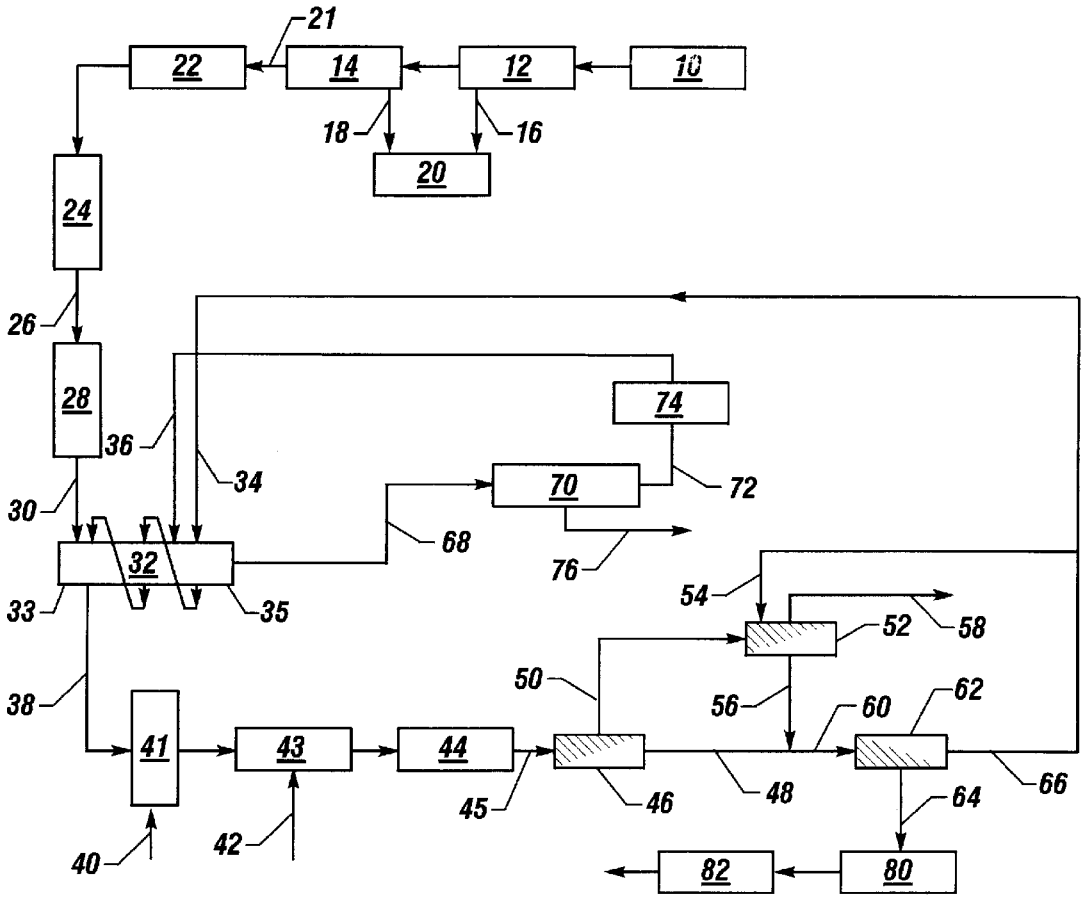
FIG. 1 is a process flow diagram showing a process of the present invention for obtaining sucrose from sugar beets.

The present invention provides an improved method for obtaining sucrose from sugar beets. One embodiment of the invention is represented in FIG. 1.

Beets received from the field are kept in a storage area 10. Fresh beets are typically used in the process, but frozen beets can also be used. Beets from the storage 10 area are flumed to a conventional beet washing apparatus 12, in which dirt is removed from the exterior of the beets. Washed beets exiting the washing apparatus pass through a conveyor 14, where water is removed. Wash water 18 and flume water 16 streams collected from this apparatus are sent to waste water treatment ponds 20.

The washed beets 21 are carried by conveying apparatus 22 to cutting apparatus 24, such as a hammer mill or slicer, in which the beets are cut into pieces, for examples pieces having an average size of about one inch thickness. The stream of beet pieces 26 from the slicer (or alternatively the whole beets 21) are fed to macerating apparatus 28. The macerating apparatus can comprise, for example, one or more hammer mills (fixed blade type being the preferred option) that uses a set of rotating blades mounted on a horizontal shaft which forces the beet material through a discharge screen. Another macerating apparatus can comprise one or more attrition mills that use discs as the primary attrition device. The discs preferably have grooves therein to facilitate maceration, and the discs can be horizontal or vertical in positioning. Disc-type attrition mills are presently preferred over hammer mills, although it is possible to use both in series (e.g., hammer mill followed by disc attrition mill). Preferably extracted juice 38 or water 34 is fed to the macerator 28 to facilitate discharge of macerated beets and/or to control the temperature of the equipment.

The stream of macerated beets 30 is fed to a vacuum juice extraction apparatus 32. This apparatus can comprise a horizontal, porous, moving belt that is subjected to a vacuum from the bottom. Macerated beets are introduced as a uniform layer at one end (the feed end) 33 of the belt. A clean water stream 34 is introduced at the opposite or discharge end 35 of the belt. Thus, the macerated beet feed and the water feed to this apparatus 32 are countercurrent to each other. A stream of juice 36 is reintroduced over the belt, preferably at several locations. This method of countercurrent filtration produces a pulp stream 68 with low sugar content and an extracted juice stream 38 with high sugar content. The countercurrent vacuum filtration process preferably is carried out at an elevated temperature of about 80° C. to control microbial growth and to improve the extraction of juice.

A centrifugal separator or a series of centrifugal separators may also be used to separate the juice 38 from the macerated beet material 68. The centrifugal separator may consist of either a vertical or horizontal rotating perforated basket in which the macerated beet material 30 is introduced into the basket and the solid phase 68 and liquid phase 38 is separated across a screen using centrifugal force. Wash water 66 and/or countercurrent extracted juice 36 is sprayed onto the macerated beet material during centrifugation to minimize sugar content in the pulp 68.

The pulp 68 leaving the juice extractor 32 has a very low sucrose content but a high water conytent. It is pressed in a screw press 70 to extract a dilute press juice 72 which contains about 1% dissolved solids and about 99% water. The dissolved solids comprise about 50% sucrose and 50% non-sugars. This dilute press juice 72 is raised to a temperature of about 80° C. in a heater 74 and then is returned to the juice extractor 32 as stream 36. Pressed pulp 76 is used as animal feed, with or without further drying.

The extracted juice 38 is sent to tank 41 and can optionally be sulfitated by the addition of sulfur dioxide, or sulfite or bisulfite salts in a stream 40, e.g. sulfur dioxide gas or aqueous ammonium bisulfite at about 65% concentration. Preferably the residual level of sulfur dioxide in the juice after sulfitation is at least 100 ppm. The sulfitation can take place at the time of slicing, macerating, juice extraction, or other points in the process, as an alternative to or in addition to the particular sulfitation step in this embodiment. This sulfitation will prevent the color increase that can otherwise take place during subsequent membrane filtration and evaporation operations. Other antioxidants may also be used.

The juice is then neutralized by the addition of aqueous sodium hydroxide 42, preferably to a pH of at least 7, in neutralization tank 43. This pH adjustment helps prevent the inversion of sugars which takes place at elevated temperatures. Other chemicals may be also be used for pH adjustment, e.g. liquid potassium hydroxide or granular sodium carbonate.

The juice extracted from the macerated beets by the countercurrent filtration process comprises about 0.2% suspended solids, about 14% dissolved solids, and about 84% water. The dissolved solids comprise about 85% sucrose and 15% non-sugars. Preferably the temperature of the extract is about 80° C. and its pH is at least 7.

The treated juice can then be passed through a heater 44 to increase its temperature to about 80° C.

The heated juice is then processed by membrane filtration 46, preferably by cross-flow ultrafiltration, to separate high molecular weight compounds from sucrose solution. Ultrafiltration produces an ultrafiltrate (also referred to as permeate or clarified juice) 48 which is about 12% dissolved solids and about 88% water. The dissolved solids comprise about 90% sucrose and 10% non-sugars. The ultrafiltrate 48 preferably has a temperature of about 80° C. and its pH is at least 7.

The permeate from ultrafiltration has a sucrose purity equivalent to the thin juice produced by the conventional beet process, which is around 90%. However, there are important differences between the non-sugars in the two products. Ultrafiltered juice may contain a higher level of invert sugar and/or a lower level of macromolecular compounds than the conventional thin juice.

Invert sugars in the ultrafiltered juice will primarily end up in the molasses without reducing sucrose recovery drastically. This is an advantage compared to the conventional liming process, which sends reaction products of lime and invert sugars to the effluent disposal system. Lower levels of macromolecular compounds result in juice with lower viscosity, which has more favorable sugar boiling characteristics.

Ultrafiltration produces a juice with reduced color. The extracted juice 38 typically has color value over 100,000 on a ICUMSA scale. The ultrafiltrate 48 typically has a color value below 2,000 on the same scale. This is equivalent to or better than the color value of thin juice prepared by the conventional method. Lower color in combination with lower viscosity result in an easier sugar boiling process. The results are higher sugar extraction, more efficient sugar boiling, and lower sugar loss to molasses.

A variety of membrane configurations can be used in the present invention, including for example spiral, hollow fiber, and tubular membranes. Membranes suitable for this separation process should have two unique characteristics. They should have high permeability to water and sucrose but have low passage of colorants and other macromolecular compounds. Tight ultrafiltration membranes with a molecular weight cutoff between about 1,000 and 10,000 and loose nanofiltration membranes with NaCl rejection of about 10% are well suited for this application. Membranes that have a negative surface charge are preferred since most compounds to be rejected are negatively charged.

The retentate 50 from the ultrafiltration process contains mostly suspended and dissolved impurities. It also contains a significant amount of sucrose. In order to recover at least some of this sucrose, the retentate is diafiltered through a membrane system 52 with addition of water 54. This diafiltration extracts most of the sugar left in the ultrafiltration retentate. The diafiltrate 56 contains about 3% dissolved solids and about 97% water. The dissolved solids in the diafiltrate comprise about 88% sucrose and 12% non-sugars. Preferably the temperature of the diafiltrate is about 80° C. and its pH is above 7. The retentate 58 of the diafiltration process contains about 5% suspended solids, 3% dissolved solids and about 87% water. This is concentrated by evaporation and used as animal feed, with or without mixing with pressed pulp.

The ultrafiltrate 48 and diafiltrate 56 are combined to form a composite product stream 60. The composite product stream (also referred to as purified juice) contains about 11% dissolved solids and about 89% water. The dissolved solids comprise about 90% sucrose and 10% non-sugars.

A reverse osmosis membrane system 62 may be used for pre-concentration of the purified juice stream. This is another cross-flow membrane process that is less energy intensive and more economical for pre-concentration of dilute sucrose solutions than the conventional process steps. The product 64 of the reverse osmosis system contains about 20% dissolved solids and about 80% water. The dissolved solids comprise about 90% sucrose and 10% non-sugars.

The permeate 66 of the reverse osmosis is high quality water. A portion 34 of this water is used in the countercurrent vacuum filtration process 32 and remainder in other plant applications, such as water feed 54 to the diafiltration process 52.

The temperature of the pre-concentrated sucrose solution 64 is then raised in a heater 80 and subsequently the remaining water is removed in evaporators 82. Sucrose is crystallized as in conventional processes.

Some of the equipment used in the process of FIG. 1 is conventional and well known to persons of ordinary skill in this field, such as beet washing equipment, pulp presses, and evaporators. Beet slicing apparatus 24 and macerating apparatus 28 are commercially available from suppliers such as H. Putsch GmbH & Company (Hagen, Germany), Maguin Company (Charmes, France), Dakota Machine Inc. (West Fargo, N.D.), and The Fitzpatrick Company (Elmhurst, Ill.). Suitable vacuum belt juice extraction apparatus is available from EIMCO Company (Salt Lake City, Utah), and Dorr-Oliver (Milford, Conn.). Centrifugal extraction apparatus is available from Western States Machine Company (Hamilton, Ohio) and Silver-Weibull (Hasslehom, Sweden). Suitable membrane filtration systems are available from suppliers such as CeraMem Corp. (Waltham, Mass.), Koch Membrane Systems, Inc. (Wilmington, Mass.), and Osmonics, Inc. (Minnetonka, Minn.).

The following table shows suitable characteristics for some of the process streams in FIG. 1, namely RDS (weight % refractive dry substance), Purity (sucrose as a % of total solids), pH, and Temp (° F.).

TABLE 1

| STREAM # | RDS | PURITY | pH | TEMP ° F. |
|---|---|---|---|---|
| 38 | 12 | 85 | 6 | 100 |
| 45 | 12 | 85 | 8 | 160 |
| 48 | 11 | 90 | 8 | 160 |
| 50 | 15 | 75 | 8 | 160 |
| 58 | 8 | 20 | 8 | 160 |
| 64 | 20 | 90 | 8 | 160 |
| 66 | 3 | 88 | 8 | 160 |
| 72 | 1 | 50 | 6 | 100 |

Many variations of the process are possible. Suitable variations include reverse osmosis before ultrafiltration, sulfitation after ultrafiltration, and sterilization of the macerated beets by chemical or physical means. Separate treatment of the press juice 72 instead of returning it to the countercurrent vacuum filtration process is another alternative. It would also be possible to include treatment with some amount of lime and/or carbonation. However, it is presently preferred to operate the process without the use of either lime or carbonation.

Chromatographic separation could be used for further purification in this process. Chromatographic separation requires juice pretreatment and juice softening. Since the juice from the present process has been passed through membrane filtration and no lime has been added, it would be excellent feed to chromatographic separation.

Further use of membrane separation in the proposed process could allow for separation of sucrose from other beet juice components such as invert sugars and oligosaccharides.

It may be possible to reduce or eliminate chemicals used for pH adjustment and sulfitation when beets of superior quality are being processed. It is also possible to operate various unit operations at somewhat different process parameters than those specified in the above-described embodiment, or in the following examples.

Leaching of macerated beets has been demonstrated to be capable of achieving 99.8% recovery of sugars in six stages, each using fresh water. Ultrafiltration of juice has also been demonstrated to be capable of achieving 99.8% sugar recovery in six stages of diafiltration. However, this degree of extraction may be too ambitious for an industrial process since it involves excessive use of dilution water, which has to be removed eventually for recovery of sugar.

Figure 2:
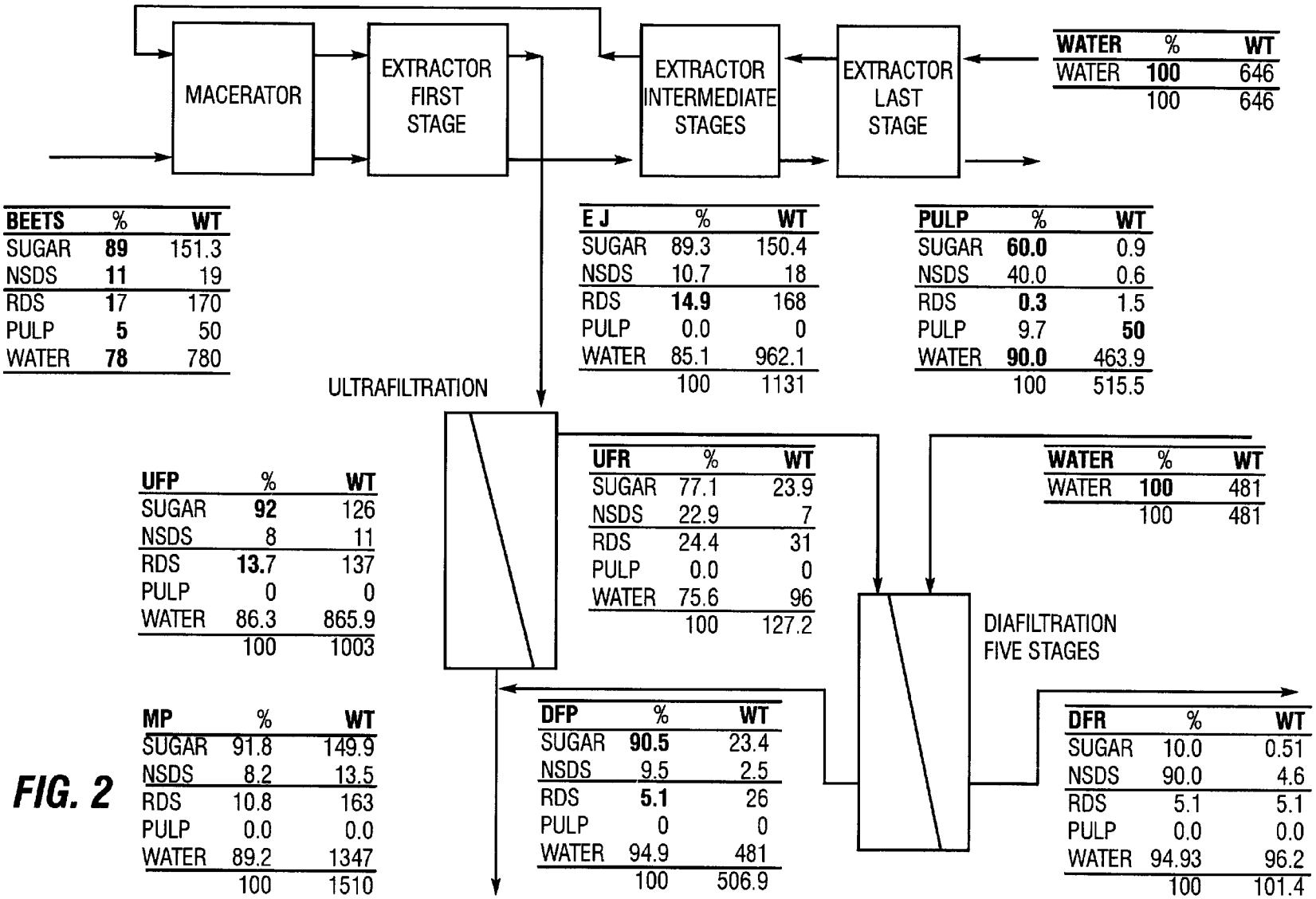
FIG. 2 is a process flow diagram with a mass balance for another embodiment of the invention.

A mass balance of a process according to the present invention was prepared based on an input of 1,000 units of beets with 78% water, 17% RDS and 89% sucrose purity, and an assumed sugar recovery of about 99.5% in both extraction and diafiltration operations. FIG. 2 shows a flow diagram of this embodiment of the process with the mass balance. The numbers in bold type are assumed based on experimental data and other available information. All other numbers are determined using constitutive and conservation relations. "EJ" refers to extracted juice, "UFP" refers to ultrafiltration permeate, "UFR" refers to ultrafiltration retentate, "DFP" refers to diafiltration permeate, "DFR" refers to diafiltration retentate, "MP" refers to mixed permeate, and "NSDS" refers to non-sugar dissolved solids.

In FIG. 2 beets are macerated with juice from the second stage of the extractor. Macerated beets are fed to the first stage of the extractor and juice from this stage is fed to the ultrafiltration system. Pulp from the first stage moves through several stages of the extractor until nearly all the sugar (99.5%) is extracted. Fresh water is introduced in the last stage of the extractor. Extracted juice is processed by ultrafiltration to recover 90% of the juice as ultrafiltrate. The retentate is diafiltered five times its volume of fresh water. Combined ultrafiltration and diafiltration recover about 99.5% of the sugar in the feed.

There could be several improvements to the process of FIG. 2. The wet pulp can be pressed to reduce moisture content to about 80% and the press water can be used to replace part of fresh water used in the extraction. Diafiltrate from the latter stages could also be used to replace some fresh water in the extraction process. These modifications would reduce the load on subsequent unit operations like drying or transport of pulp and reverse osmosis or evaporation of juice. However, these measures would reduce the efficiency of the extraction process, requiring more stages.

EXAMPLE 1

Expelled Juice Clarification

Macerated beet pulp was mixed with water and pressed in cloth bags to produce a sample of expelled juice. This sample was treated with sodium hydroxide, heated and used in a set of ultrafiltration trials. Two different spiral ultrafiltration membranes were used in the trial, a Hydranautics model NTR7410 membrane and a Koch model HFK131 membrane. The trials produced satisfactory flux rates, higher than comparable trials with conventional beet diffusion juice.

TABLE 2

Ultrafiltration of Expelled Juice — Trial Parameters and Fluxes

| | | Membrane | Trial Conditions | | Trial Results | |
|---|---|---|---|---|---|---|
| Trial No. | Pretreatment | Type | Temp. ° F. | Pressure PSIG | Recovery (%) | Flux LMH |
| 1 | NaOH-Heat | Spiral | 150 | 70 | 86 | 30 |
| 2 | NaOH-Heat | Spiral | 150 | 70 | 86 | 25 |

There was a significant reduction in RDS and a very significant increase in sucrose purity across the membrane. Both membranes rejected over 99% of the color value. The increase in sucrose purity and color separation during these trials were much higher than comparable trials with conventional beet diffusion juice.

TABLE 3

Ultrafiltration of Expelled Juice — Separation Characteristics

| Trial | Recovery | RDS (%) | | | Sucrose (% of RDS) | | | Color | | |
|---|---|---|---|---|---|---|---|---|---|---|
| No. | (%) | Feed | Retn. | Perm. | Feed | Retn. | Perm. | Feed | Retn. | Perm. |
| 1 | 86 | 8.9 | 10.0 | 7.7 | 85.8 | 78.4 | 91.1 | 67256 | 158785 | 925 |
| 2 | 86 | 8.9 | 10.0 | 7.8 | 85.8 | 78.4 | 90.6 | 67256 | 158785 | 1138 |

("Retn." refers to retentate and "Perm." to permeate.)

EXAMPLE 2

A beet maceration trial was conducted using a Bauer atmospheric disc refiner. This machine has two 12" discs with adjustable gap, one disc stationary and other disc driven by a 60 hp motor. About 20 kg of beets were used in the trial. Beets were chopped to ¾ inch pieces to suit the screw feeder.

All the beet chips were passed through the machine in one pass. Water was used to push the material through the machine, which resulted in dilution of juice. A part of the macerated product was pressed in a bladder press at 20 psi for about 15 minutes. Another part of the product was allowed to drain on a wire screen box.

TABLE 4

| Material | Concentration |
|---|---|
| Juice from bladder press | 9.2 Brix |
| Press cake from bladder press | 32.5% dry solids |
| Filter cake from screen box | 15.0% dry solids |

The pulp from the first pass was processed through the machine again in a second pass. The gap between the discs was set to about 10 mil for this pass. The macerated pulp was pressed in the bladder press at 20 psi for about 15 minutes.

TABLE 5

| Material | Concentration |
|---|---|
| Juice from bladder press | 7.6 Brix |
| Press cake from bladder press | 21.0% dry solids |

(The lower solids content in the pass 2 bladder press cake was due to its higher thickness.)

Pass 2 pulp drained under vacuum had a dry solids content of 22%. When it was washed in excess water and drained under vacuum, the solids content was only 15%. This indicated that ⅔ of the solids in the pulp were dissolved and easily washable. The washed pulp had a residual sugar content of about 0.5%.

Pass 2 pulp had poor filtration characteristics when subjected to a vacuum on a filter paper. However, on a 0.5 mm screen, a 25 mm thick pulp layer had filtration rates around 5,000 gfd.

These studies produced the following results:

1. The disc refiner pulped the beet with low power consumption (~3 kWh/ton).
2. The pulp had good vacuum filtration characteristics (~5,000 gfd with 25 mm cake).
3. The vacuum filter cake (after washing) had low residual sugar (~0.5%).
4. The filter cake may be pressed to produce a drier pulp by-product (~30%).
5. The expelled juice had satisfactory ultrafiltration characteristics ( 25 gfd).
6. Ultrafiltration rejected color bodies in the expelled juice well (99%).
7. The ultrafiltrate of expelled juice has good sugar boiling characteristics.

EXAMPLE 3

About 3,000 lb of beets were macerated in fixed hammer mills for about 30 minutes, producing about 400 gallons of juice. The maceration involved two passes. The first pass was through two grinders and two extractors, and the second pass was through one grinder and two extractors. The excess water added to the hammer mills to facilitate discharge of the macerated beets diluted the juice to about 4% RDS. The juice was filtered through a #200 mesh vibratory screen. No visible residue was left on the screen.

The juice was heated to about 170° F. and ultrafiltered through a Koch HFK 131 ultrafiltration spiral membrane module with an 80 mil spacer. The inlet and outlet pressures were maintained at 60 and 40 psig. Table 6 summarizes the results.

TABLE 6

Ultrafiltration of Expelled Juice — Trial Parameters and Fluxes, and Separation Characteristics

| Time | Recovery | Temp. | Flux | RDS (%) | | | Sucrose (%) | | | Color | | |
|---|---|---|---|---|---|---|---|---|---|---|---|---|
| (min.) | (%) | (° F.) | (lmh) | Retn. | Perm. | Rej. | Retn. | Perm. | Rej. | Retn. | Perm. | Rej. (%) |
| 0 | 0 | 176 | 135 | 4.6 | 4.3 | 6.5 | 78.7 | 80.6 | 4.3 | 76,946 | 6,781 | 91.8 |
| 35 | 33 | 161 | 90 | 5.3 | 4.4 | 17.0 | 70.8 | 81.2 | 4.8 | 130,128 | 6,313 | 96.0 |
| 50 | 50 | 166 | 90 | 6.4 | 4.6 | 28.1 | 61.1 | 81.5 | 4.2 | 208,396 | 5,442 | 98.1 |
| 55 | 67 | 167 | 83 | 7.8 | 4.8 | 38.5 | 50.2 | 80.3 | 1.6 | 308,950 | 5,103 | 99.0 |
| 70 | 83 | 161 | 45 | 12.1 | 5.4 | 55.4 | 35.6 | 78.0 | 2.3 | 588,757 | 10,335 | 99.2 |

"Rej." refers to rejection.

Note: This test was performed to evaluate the ability to process deteriorated beets. The feed beet material used for this test is substantially lower in purity than normal beets — this accounts for the lower permeate purities and higher permeate colors.

EXAMPLE 4

A set of leaching trials was conducted using a centrifuge as the leaching device. Macerated pulp was prepared by processing beets through a hammer mill of the Rietz Disintegrate type. The centrifuge was an American Machinery and Metals basket type centrifuge, whose basket was 18 inches in diameter and 10 inches deep, and was driven by a 3 hp, 1,700 rpm electric motor. A sleeve made of filter cloth was used as a liner inside the basket to contain the filter cake.

A five-gallon volume of the macerated pulp was centrifuged for about two minutes and the extracted juice was collected. The cake was remixed with an equal volume of water and centrifuged again. This procedure was repeated six times. Samples of the extracted juice and cake were collected at the end of each run. The results of one trial are summarized in Table 7.

The results indicate that the sucrose content in the juice and pulp decreased by half in every step. This is to be expected since the cake was mixed with an equal volume of water at each step. The sugar content of the pulp after six steps was 0.03%. This translates to extraction of 99.8% of sugar in the beets.

TABLE 7

| Leaching Trial Results | | | | | | | |
|---|---|---|---|---|---|---|---|
| | Juice | | | Pulp | | | |
| Run # | RDS % | Sucrose Purity (% of RDS) | % Sugar | Water % | RDS % | Sucrose Purity (% of RDS) | % Sugar |
| 1 | 21.6 | 89.7 | 19.38 | 70.9 | 2.7 | 87.1 | 1.67 |
| 2 | 9.0 | 89.9 | 8.09 | 78.3 | 1.4 | 80.3 | 0.88 |
| 3 | 4.4 | 90.1 | 3.96 | 80.9 | 0.7 | 75.9 | 0.43 |
| 4 | 2.1 | 86.6 | 1.82 | 81.7 | 0.4 | 54.2 | 0.18 |
| 5 | 1.1 | 79.3 | 0.87 | 82.8 | 0.4 | 24.9 | 0.08 |
| 6 | 0.5 | 74.3 | 0.37 | 82.6 | 0.2 | 21.1 | 0.03 |

EXAMPLE 5

A short trial was conducted with expelled juice ultrafiltrate/diafiltrate, to evaluate possibilities of preconcentration using reverse osmosis. The trial utilized a Hydranautics model ESPA spiral reverse osmosis membrane and was conducted at 800 psi at about 100° F. The flux and separation characteristics recorded in this trial are listed in Table 8.

TABLE 8

| Reverse Osmosis of Extracted Juice Flux and Rejection Characteristics | | | | | | | |
|---|---|---|---|---|---|---|---|
| Recovery | Flux | RDS (%) | | | Sucrose (% of RDS) | | |
| (%) | (Lmh) | Retn. | Perm. | Rej. | Retn. | Perm. | Rej. |
| Feed | | 13.5 | | | 12.5 | | |
| 10 | 65 | 14.4 | 0.4 | 97.2 | 13.4 | 0.3 | 97.5 |
| 60 | 31 | 25.2 | 1.4 | 94.4 | 23.2 | 1.3 | 94.5 |

The preceding description of specific embodiments of the present invention is not intended to be a complete list of every possible embodiment of the invention. Persons skilled in this field will recognize that modifications can be made to the specific embodiments described here that would be within the scope of the present invention.

What is claimed is:

1. A process for producing sugar from beets, comprising the steps of:

(a) macerating beets or pieces thereof;

(b) mechanically separating juice from the macerated beets at a temperature of at least about 80 °C; and (c) membrane filtering the separated juice, producing a retentate and a permeate.

2. The process of claim 1, where beets are cut into pieces and subsequently macerated.

3. The process of claim 2, where the maceration is done in an attrition mill.

4. The process of claim 1, where the mechanical separation of juice is done on a moving porous vacuum filtration belt with countercurrent flow of macerated beets and water.

5. The process of claim 1, where the mechanical separation is done using centrifugation.

6. The process of claim 1, where the mechanical separation is done using vacuum filtration.

7. The process of claim 6, where the pH of the vacuum separated juice is adjusted to at least about 7 by addition of sodium hydroxide.

8. The process of claim 6, where the separated juice is contacted with an agent selected from the group consisting of sulfur dioxide, sulfate salts, sulfite salts, bisulfite salts, and mixtures thereof, in an amount sufficient to adjust the pH of the extracted juice to at least about 7.

9. The process of claim 1, where the membrane filtration is done with an ultrafiltration membrane.

10. The process of claim 1, where the membrane filtration is done with a nanofiltration membrane.

11. The process of claim 9, where the membrane filtration is cross-flow ultrafiltration, and is done at least about 80° C., and the pH of the permeate is at least about 7.

12. The process of claim 1, where the retentate from the membrane filtration is subjected to diafiltration to recover residual sugar in the retentate.

13. The process of claim 12, where the diafiltration filtrate is combined with the membrane filtration permeate for further processing.

14. The process of claim 1, where the permeate from the membrane filtration is concentrated by reverse osmosis, producing a concentrated solution.

15. The process of claim 14, where the concentrated solution is evaporated and sucrose is crystallized therefrom.

16. The process of claim 1, where no lime and no carbon dioxide are contacted with the juice or the permeate.

17. A process for producing sugar from beets, comprising the steps of:

(a) cutting sugar beets into pieces;

(b) macerating the beet pieces;

(c) mechanically extracting juice from the macerated beets at a temperature of at least about 80 °C;

(d) membrane filtering the extracted juice, producing a retentate and a permeate;

(e) subjecting the retentate to diafiltration, thereby producing a dialfiltration filtrate that is enriched in sugar compared to the retentate;

(f) combining the dialfiltration filtrate and the permeate from the membrane filtration, thereby producing a combined juice;

(g) concentrating the combined juice by reverse osmosis, thereby producing a concetrated solution; and (h) evaporating the concentrated solution and crystallizing sucrose therefrom.

* * * * *

UNITED STATES PATENT AND TRADEMARK OFFICE

CERTIFICATE OF CORRECTION

PATENT NO. : 6,387,186 B1 
DATED : May 14, 2002
INVENTOR(S) : Richard C. Reisig and Jatal D. Mannapperuma It is certified that error appears in the above-identified patent and that said Letters Patent is hereby corrected as shown below:

Column 12,
Line 52, delete "concetrated" and insert -- concentrated --.

Signed and Sealed this

Ninth Day of July, 2002

*Attest:*

*Attesting Officer*

JAMES E. ROGAN
*Director of the United States Patent and Trademark Office*